US007869615B2

(12) United States Patent
Chang

(10) Patent No.: US 7,869,615 B2
(45) Date of Patent: Jan. 11, 2011

(54) SOUND-BOX TYPE EARPHONE HOUSING, HEADSET WITH SOUND-BOX TYPE EARPHONE HOUSINGS

(76) Inventor: Chi-Tsan Chang, 2/F., No. 17, Chihyuan 1st Rd., Sec. 1, Peitou Dist., Taipei City (TW)

( * ) Notice: Subject to any disclaimer, the term of this patent is extended or adjusted under 35 U.S.C. 154(b) by 1162 days.

(21) Appl. No.: 11/515,725

(22) Filed: Sep. 6, 2006

(65) Prior Publication Data

US 2008/0075314 A1 Mar. 27, 2008

(51) Int. Cl.
*H04R 25/00* (2006.01)

(52) U.S. Cl. ..... 381/371; 381/380

(58) Field of Classification Search ..... 381/370, 381/371, 380; 379/430; 455/575.2
See application file for complete search history.

(56) References Cited

U.S. PATENT DOCUMENTS 6,154,890 A * 12/2000 Deopuria et al. ..... 381/371
2004/0184635 A1* 9/2004 Natvig ..... 381/371

* cited by examiner

*Primary Examiner*—Brian Ensey
(74) *Attorney, Agent, or Firm*—Rosenberg, Klein & Lee

(57) ABSTRACT

A sound box type earphone housing for use in a headset is disclosed to include a body shell having a coupling flange, a springy earphone clamp fastened to the inside of the body shell and having a front clamping hole for securing an earplug type earphone, and an annular cover member, which has a coupling groove coupled to the coupling flange of the body shell, a center opening hole, and a hanging portion extending around the top side of the center opening hole for hanging the annular cover member on the user's ear.

7 Claims, 5 Drawing Sheets

SOUND-BOX TYPE EARPHONE HOUSING, HEADSET WITH SOUND-BOX TYPE EARPHONE HOUSINGS

BACKGROUND OF THE INVENTION

1. Field of the Invention

The present invention relates to headphones and more particularly, to a headset having sound-box type earphone housings.

2. Description of the Related Art

Regular commercial earphones include earplug type earphones, ear-hang type earphones, and headset type earphones. When using earplug type earphones, the earphones are respectively inserted into the external auditory canals of the ears. The user's ears may feel uncomfortable after a long use of the earplug type earphones. Ear-hang type earphones are comfortable in use. However, loud external noises may interfere with the sound effect of the ear-hang type earphones. Headset type earphones have the same drawback as ear-hang type earphones. Further, headset type earphones are more expansive, and inconvenient to carry. Further, headset type earphones do not allow the user to change the speakers.

SUMMARY OF THE INVENTION

The present invention has been accomplished under the circumstances in view. According to one aspect of the present invention, the sound box type earphone housing comprises a body shell, which has a coupling flange, a springy earphone clamp fastened to the inside of the body shell for securing an earplug type earphone, and an annular cover member, which has a coupling groove coupled to the coupling flange of the body shell, a center opening hole, and a hanging portion extending around the top side of the center opening hole for hanging the annular cover member on the user's ear to keep the earplug type earphone aimed at the external auditory canal without touching. According to another aspect of the present invention, the body shell works as a sound box to enhance the sound outputted from the earplug type earphone. According to still another aspect of the present invention, the springy earphone clamp has a clamping hole capable of securing any of a variety of earplug type earphones

DETAILED DESCRIPTION OF THE PREFERRED EMBODIMENT

Figure 1:
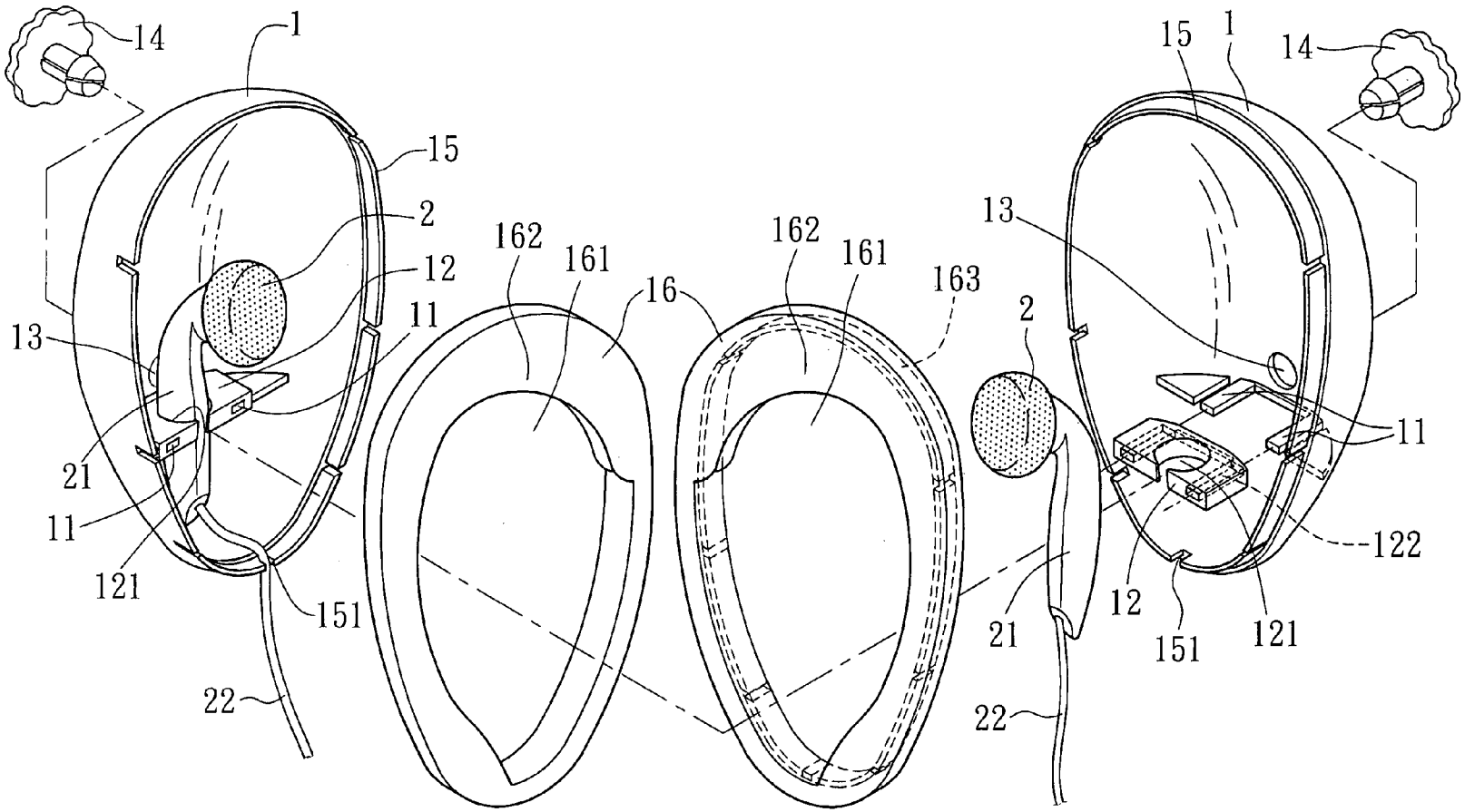
FIG. 1 is an exploded view of a part of a headset according to the present invention.
Figure 2:
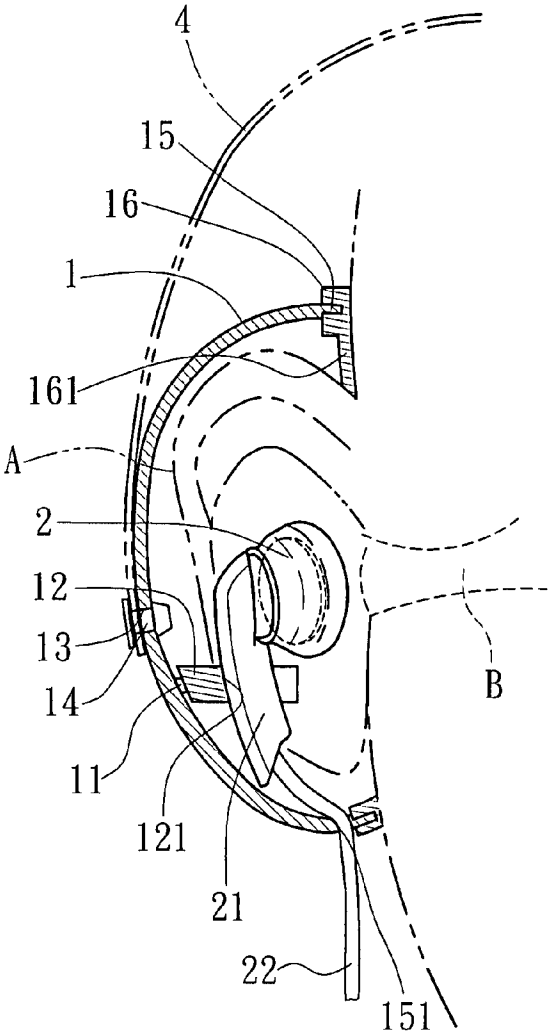
FIG. 2 is a schematic drawing showing the sound box type earphone housing fastened to the ear according to the present invention.

Referring to FIGS. 1 and 2, a sound box type earphone housing in accordance with the present invention is shown comprising a body shell 1, an earphone clamp 12 detachably fastened to the body shell 1 to hold an earplug type earphone 2 inside the body shell 1, and an annular cover member 16 capped on the body shell 1 for hanging on the user's one ear A. The body shell 1 works as a sound box, having two plug members 11 fixedly suspending on the inside and sloping slightly downwardly forwards for securing the earphone clamp 12. The earphone clamp 12 is springy, having two rear plug holes 122, which are respectively fastened to the plug members 11 to secure the earphone clamp 12 firmly to the body shell 1, and a front clamping hole 121 for securing the handle 21 of the earplug type earphone 2, a coupling flange 15 extending around the open side thereof for holding the annular hanging member 161, and a wire notch 151 on the coupling flange 15 for the passing of the electric wire 22 of the earplug type earphone 2. The annular cover member 16 has a center opening hole 161 corresponding to the earplug type earphone 2 in the body shell 1, a coupling groove 163 fastened to the coupling flange 15 of the body shell 1, and a hanging portion 162 extending around the top side of the center opening hole 161 for hanging the annular cover member 16 on the user's ear A. When the annular cover member 16 is hung on the user's ear A, the earplug type earphone 2 is aimed at the external auditory canal B of the user's ear A without touching the external auditory canal B.

Figure 3:
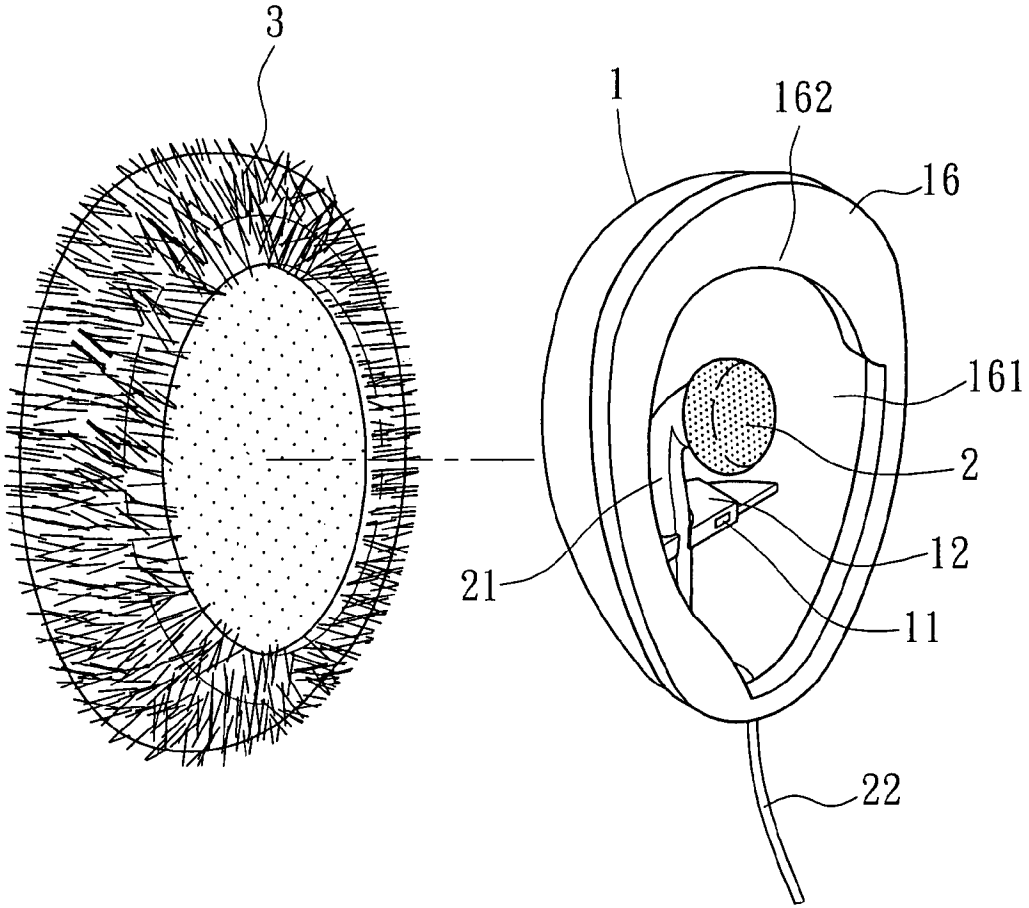
FIG. 3 is an exploded view of a soft covering and one sound box type earphone housing according to the present invention.

Referring to FIG. 3, a soft covering 3 may be used and covered on the body shell 1 to keep the user's ear A warm during the winter.

Figure 4:
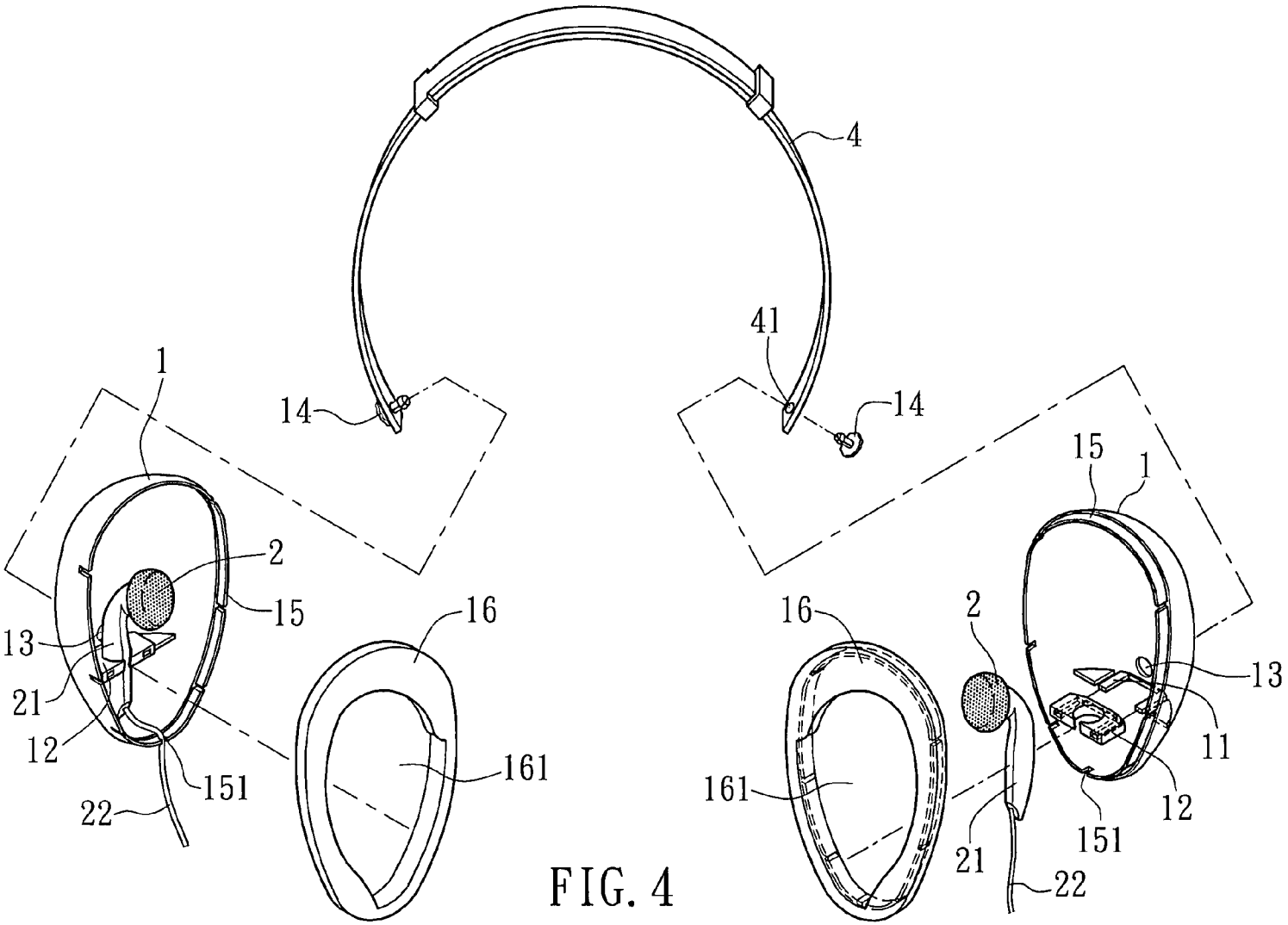
FIG. 4 is an exploded view of the headset according to the present invention.

Referring to FIG. 4 and FIGS. 1 and 2 again, two sound box type earphone housings are used with a headband 4 to constitute a headset. The body shell 1 of each sound box type earphone housing has a through hole 13 fastened to a through hole 41 at each end of the headband 4 with a fastener 14.

Figure 5:
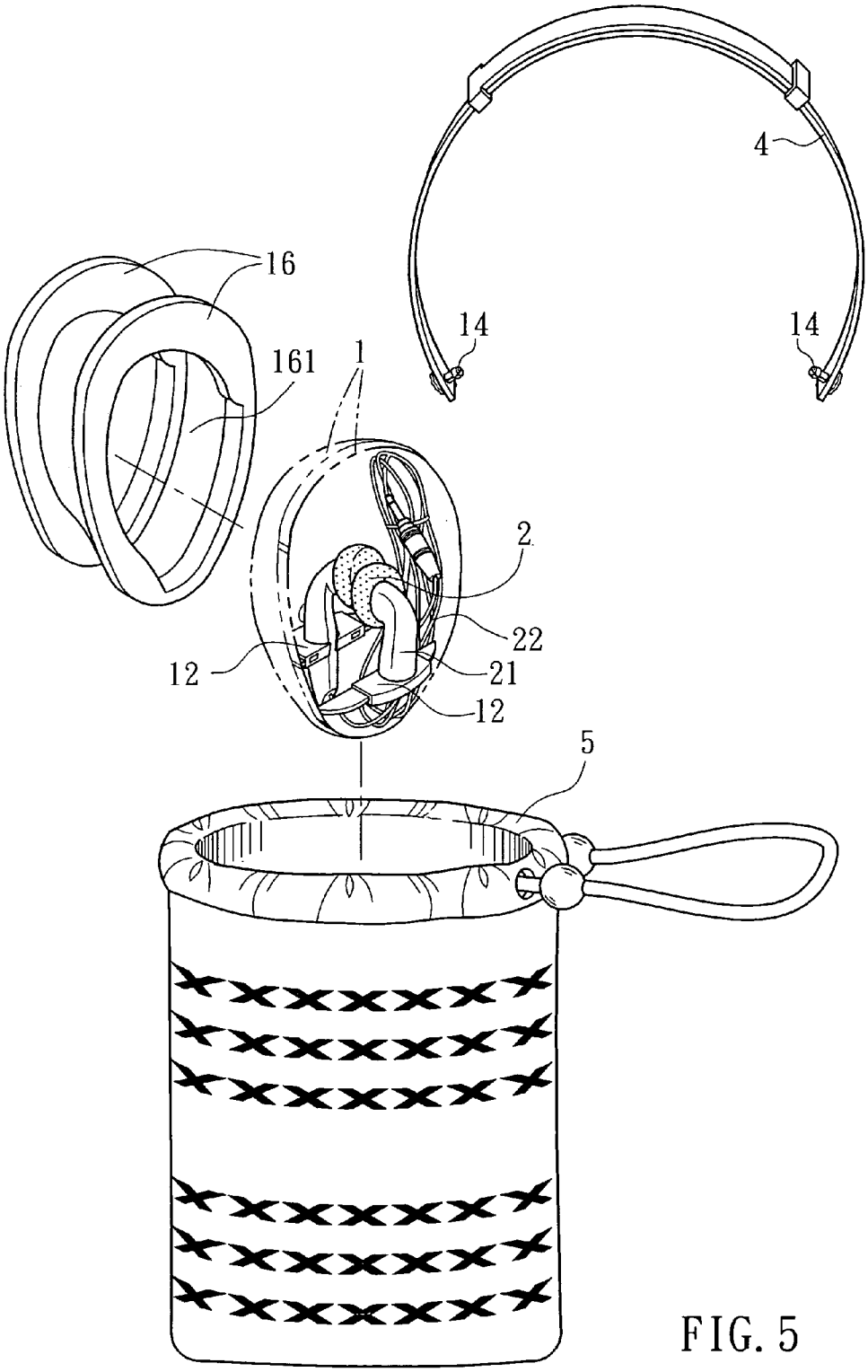
FIG. 5 illustrates a drawstring bag and detached status of the headset according to the present invention.

Referring to FIG. 5, a drawstring bag 5 is provided for receiving the parts of the headset when the headset is not used.

A prototype of headset with sound-box type earphone housings has been constructed with the features of FIGS. 1~5. The headset with sound-box type earphone housings functions smoothly to provide all the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A sound box type earphone housing comprising:

a body shell working as a sound box, said body shell having a coupling flange extending around an open side thereof and a plurality of plug members fixedly suspending on the inside;

an earphone clamp made of a springy material and provided inside said body shell, said earphone clamp having a front clamping hole for securing an earplug type earphone, said earphone clamp having a plurality of rear plug holes respectively fastened to said plurality of plug members; and an annular cover member for securing said body shell to the user's ear, said annular cover member having a coupling groove coupled to the coupling flange of said body shell, a center opening hole, and a hanging portion extending around a top side of said center opening hole for hanging said annular cover member on the user's ear.

2. The sound box type earphone housing as claimed in claim 1, wherein said plug members of said body shell slope downwardly forwards to hold said earphone clamp in a sloping position.

3. The sound box type earphone housing as claimed in claim 1, further comprising a soft covering for covering said body shell.

4. A headset comprising:

two sound box type earphone housings, said sound box type earphone housings each comprising a body shell working as a sound box, said body shell having a coupling flange extending around an open side thereof and a mounting through hole, an earphone clamp made of a springy material and provided inside said body shell, said earphone clamp having a front clamping hole for securing an earplug type earphone, and an annular cover member for securing said body shell to a person's one ear, said annular cover member having a coupling groove coupled to the coupling flange of said body shell, a center opening hole, and a hanging portion extending around a top side of said center opening hole for hanging said annular cover member on the a person's one ear;

a headband, said headband having a through hole on each of two distal ends thereof; and two fasteners respectively fastened to the mounting through hole of the body shell of each of said two sound box type earphone housings and the through holes of said headband to secure said sound box type earphone housings to said headband.

5. The sound box type earphone housing as claimed in claim 4, wherein the body shell of each of said sound box type earphone housings has a plurality of plug members fixedly suspending on the inside; the earphone clamp of each of said sound box type earphone housings has a plurality of rear plug holes respectively fastened to the plug members of the associating body shell.

6. The sound box type earphone housing as claimed in claim 5, wherein the plug members of the body shell of each of said sound box type earphone housing slope downwardly forwards to hold associating earphone clamp in a sloping position.

7. The sound box type earphone housing as claimed in claim 4, further comprising two soft coverings for covering the body shells of said sound box type earphone housings.

* * * * *